US006865341B1

(12) United States Patent
Hurley

(10) Patent No.: US 6,865,341 B1
(45) Date of Patent: Mar. 8, 2005

(54) SMOKE PRODUCING SYSTEM

(76) Inventor: Lyndon J. Hurley, P.O. Box 70, Harrisburg, SD (US) 57032

( * ) Notice: Subject to any disclaimer, the term of this patent is extended or adjusted under 35 U.S.C. 154(b) by 72 days.

(21) Appl. No.: 10/463,367

(22) Filed: Jun. 17, 2003

(51) Int. Cl.[7] ..... F22B 29/06
(52) U.S. Cl. ..... 392/396; 392/399; 392/386
(58) Field of Search ..... 392/386, 394, 392/396, 406

(56) References Cited

U.S. PATENT DOCUMENTS

| | | | | |
|---|---|---|---|---|
| 219,311 | A | | 9/1879 | Salisbury |
| 734,871 | A | | 7/1903 | Hopwood et al. |
| 736,652 | A | | 8/1903 | Taboulevitsch |
| 1,322,374 | A | | 11/1919 | Trumble |
| 4,330,428 | A | | 5/1982 | Clifford |
| 4,349,723 | A | | 9/1982 | Swiatosz |
| 4,764,660 | A | | 8/1988 | Swiatosz |
| 5,107,698 | A | | 4/1992 | Gilliam |
| 5,220,637 | A | | 6/1993 | Levin, III et al. |
| 5,753,800 | A | | 5/1998 | Gilliam |
| 5,859,363 | A | | 1/1999 | Gouge |
| 5,922,944 | A | | 7/1999 | Pieroni et al. |
| 5,937,141 | A | * | 8/1999 | Swiatosz ..... 392/397 |
| 6,142,009 | A | | 11/2000 | Loblick |
| 6,439,031 | B1 | | 8/2002 | Pieroni et al. |

* cited by examiner

*Primary Examiner*—Thor Campbell

(57) ABSTRACT

A smoke producing system for efficiently producing reduced toxin smoke includes a heating chamber heated by a heat source. A coil passes into and through the heating chamber to deliver a smoke producing substance, typically a liquid, to the hottest portion of the heating chamber. The substance is heated above a flash point of the substance before it is released from the coil into the hottest part of the heating chamber where it is immediately converted to smoke. The smoke then passes from the hottest portion of the chamber through a convoluted path to an outlet port. In a particular embodiment, the smoke producing system incorporates a fan assembly used as the heat source and for directing the smoke produced in a desired direction.

9 Claims, 3 Drawing Sheets

SMOKE PRODUCING SYSTEM

BACKGROUND OF THE INVENTION

1. Field of the Invention

The present invention relates to smoke producers and more particularly pertains to a new smoke producing system for efficiently producing reduced toxin smoke.

2. Description of the Prior Art

The use of smoke producers and heating chambers is known in the prior art. U.S. Pat. No. 5,107,698 issued Apr. 28, 1992, to Gilliam describes a device and method for in situ testing of an internal combustion engine for vacuum leaks. Another type of smoke producer is U.S. Pat. No. 4,349,723 issued Sep. 14, 1982, to Swiatosz in which a smoke producing liquid is heated and sprayed into a heating chamber through an atomizing nozzle. U.S. Pat. No. 219,311 issued Sep. 2, 1879 to Salisbury discloses a coil steam boiler assembly showing structure for heating a liquid. U.S. Pat. No. 5,220,637 issued Jun. 15, 1993, to Levin III et al. discloses a smoke producing device that distributes smoke producing liquid onto the interior of a heated tube in the presence of a spiraling gas flow within the tube to heat the liquid for producing smoke that flows out of the top of the tube. U.S. Pat. No. 5,922,944 issued Jul. 13, 1999, to Pieroni et al. discloses a smoke producing apparatus that utilizes a heating element positioned above a supply of fluid that is incrementally injected towards the heating element by a tube extending through the fluid and drawing the fluid into the tube through an inlet opening when air is passed through the tube and out towards the heating element. U.S. Pat. No. 5,859,363 issued Jun. 12, 1999, to Gouge discloses a device that also uses a pool of fluid positioned in a smoke producing chamber below a heating element extending through the chamber. U.S. Pat. No. 5,753,800 issued May 19, 1998, to Gilliam discloses an apparatus for using smoke to test the exhaust system of an internal combustion engine. U.S. Pat. No. 6,439,031 issued Aug. 27, 2002, to Pieroni et al. discloses a method of smoke testing that utilizes the structure of the earlier describe Pieroni patent and a dye for facilitating identification of leakage points. U.S. Pat. No. 6,142,009 issued Nov. 7, 2000, to Loblick discloses another smoke producing device that utilizes an atomizing nozzle to introduce smoke producing liquid into a heated chamber. U.S. Pat. No. 4,764,660 issued Aug. 16, 1988, to Swiatosz discloses an electric portable device for heating a smoke producing liquid to produce smoke. U.S. Pat. No. 734,871 issued Jul. 28, 1903, to Hopwood discloses a steam generator structure. U.S. Pat. No. 736,652 issued Aug. 18, 1903, to Taboulevitsch discloses another steam producing structure. U.S. Pat. No. 4,330,428 issued May 18, 1982, to Clifford discloses a smoke generator that includes additional conduits for selectively flushing the device of ash and other accumulated particulate matter. U.S. Pat. No. 1,322,374 issued Nov. 18, 1919, to Trumble discloses another steam boiler structure.

While these devices fulfill their respective, particular objectives and requirements, the need remains for a device that produces large amounts of smoke in a highly efficient and clean manner to prevent the production of toxic by-products.

SUMMARY OF THE INVENTION

The present invention meets the needs presented above by providing a heating chamber heated by a heat source. A coil passes through the heating chamber to deliver a smoke producing substance to the hottest portion of the heating chamber. The substance is released into the chamber where it is immediately converted to smoke. The smoke then passes from the hottest portion of the chamber through a convoluted path within the chamber and out of an outlet opening.

An object of the present invention is to provide a new smoke producing system that fully combusts a smoke producing substance to reduce toxic by-products during smoke production.

Another object of the present invention is to provide a new smoke producing system that utilizes a superheating smoke production chamber to increase the quantity of smoke produced using a given amount of smoke producing substance.

Yet another object of the present invention is to introduce a smoke producing substance into a chamber heated above the flash point of the substance at the hottest area of the chamber to maximize smoke production.

Even still another object of the present invention is to reduce substance residue from the smoke producing substance by superheating the substance within the coil so that there is virtually no substance residue dispensed from the coil into the heating chamber.

Yet even another object of the present invention is to reduce substance residue from the smoke producing substance by dispensing the substance from the coil directly into the hottest portion of the heating chamber.

Still yet another object of the present invention is to reduce substance residue from the smoke producing substance by collecting any substance residue within the chamber to convert the substance residue to smoke before it can escape the chamber.

Yet even another object of the present invention is to maximize the length of coil within the heating chamber and maximize the distance the smoke travels within the heating chamber before being dispensed through the outlet opening.

To this end, the present invention generally comprises a heating chamber heated by a heat source. A coil passes into and through the heating chamber to deliver a smoke producing substance, typically a liquid, to the hottest portion of the heating chamber. The substance is heated above a flash point of the substance before it is released from the coil into the hottest part of the heating chamber where it is immediately converted to smoke. The smoke then passes from the hottest portion of the chamber through a convoluted path to an outlet port.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
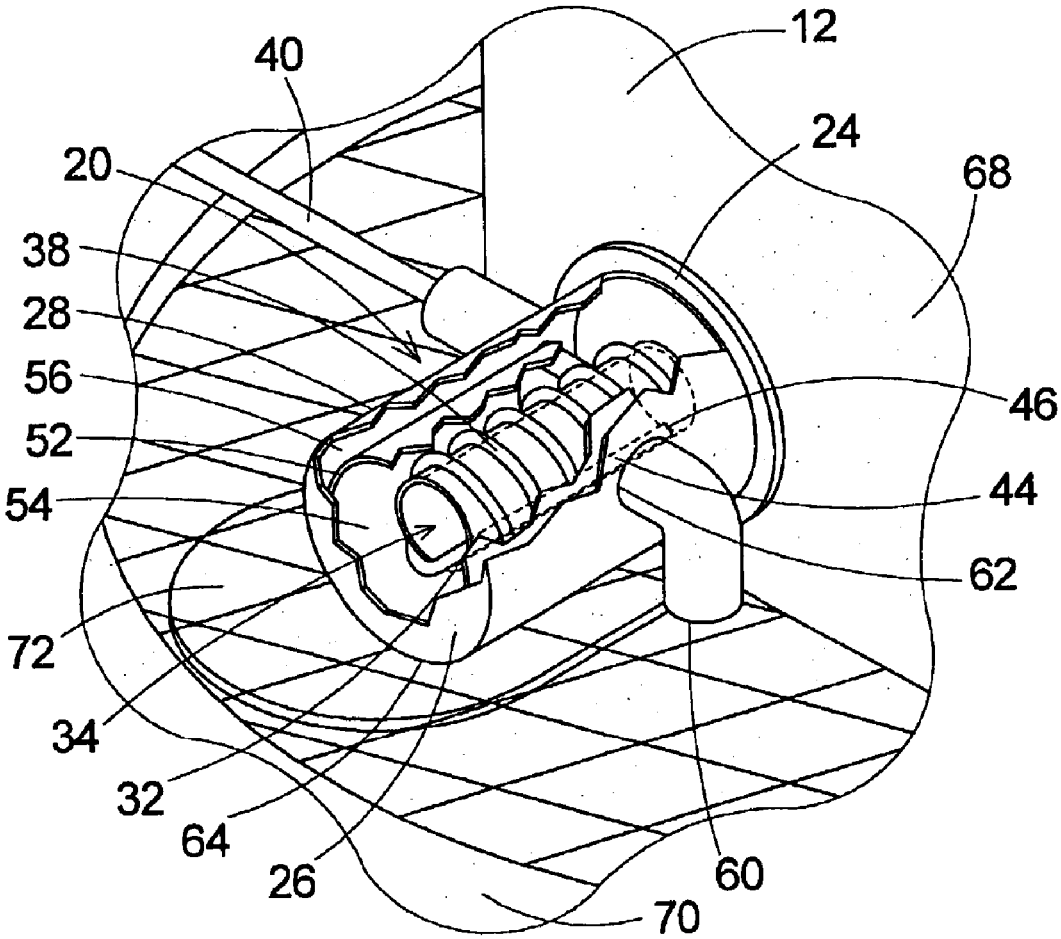
FIG. 1 is a partial cut-away perspective view of a new smoke producing system according to the present invention.
Figure 2:
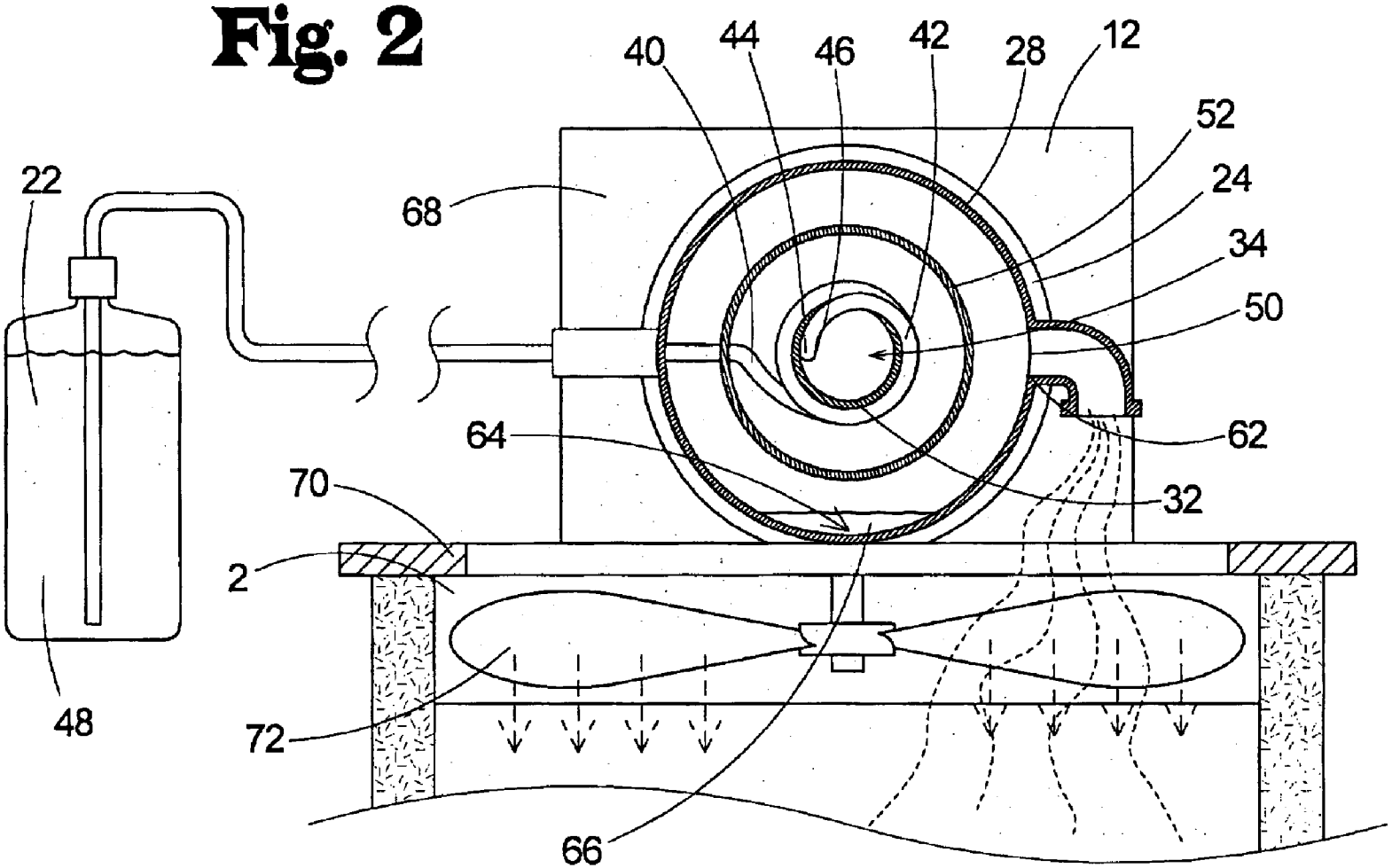
FIG. 2 is a cross-sectional end view of the present invention.
Figure 3:
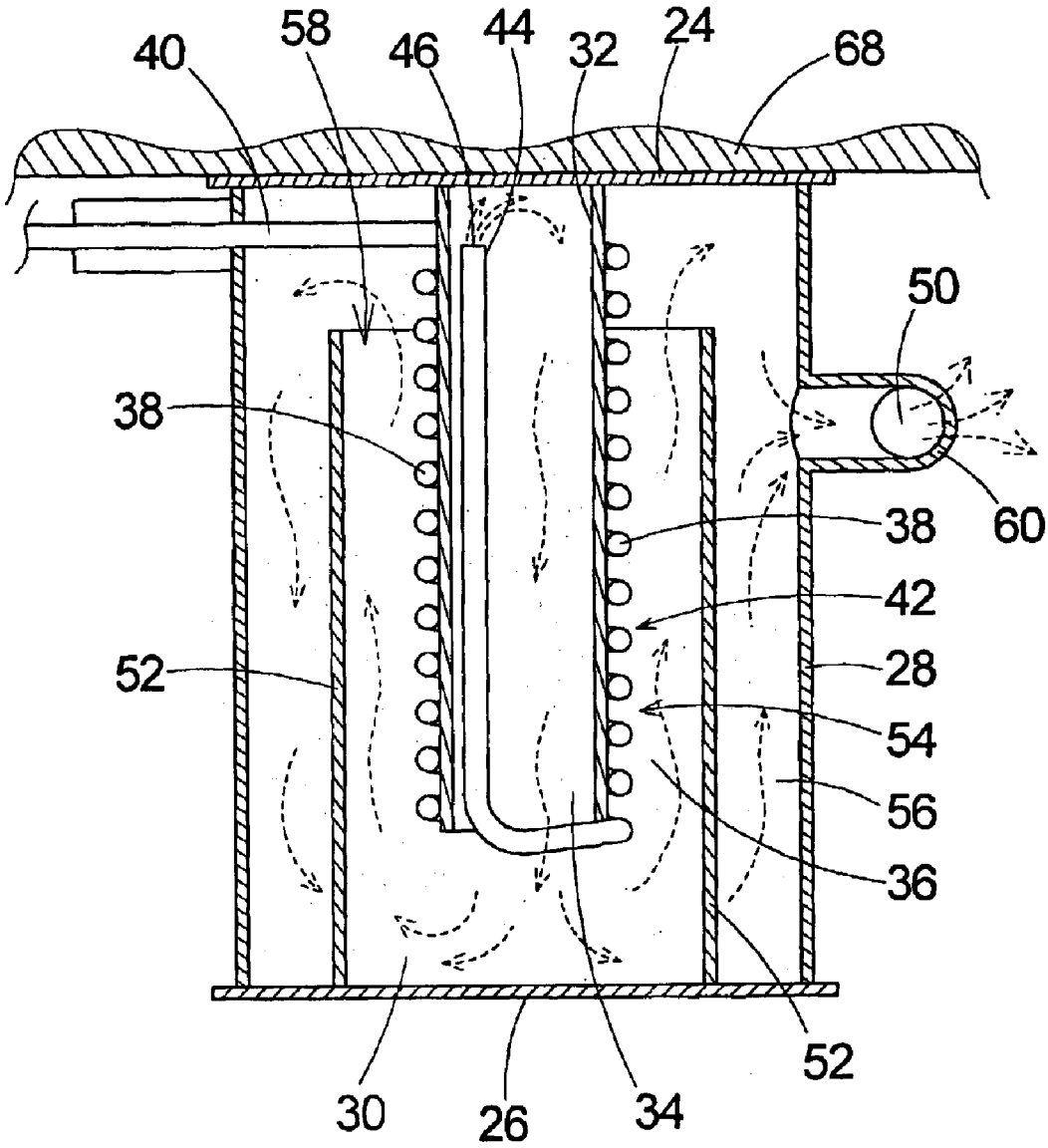
FIG. 3 is a cross-sectional top view of the present invention.

With reference now to the drawings, and in particular to FIGS. 1 through 3 thereof, a new smoke producing system embodying the principles and concepts of the present invention and generally designated by the reference numeral 10 will be described.

As best illustrated in FIGS. 1 through 3, the smoke producing system 10 generally comprises a heat source 12, a heating chamber 20, and a smoke producing substance 22 that is passed through the heating chamber 20 to produce smoke.

The heating chamber 20 includes first and second end walls 24 and 26 respectively. The first end wall 24 is heated by the heat source 12. The heating chamber 20 includes an outer wall 28 extending between the first and second end walls 24,26 to define an interior 30 of the heating chamber 20.

The heating chamber 20 also includes an inner wall 32 extending from the first end wall 24 into the interior 30 to define an inner chamber 34 and an outer chamber 36 within the heating chamber 20.

A coil 38 is used to bring the substance 22 into the heating chamber 20. The coil 38 includes a first portion 40 extending into the heating chamber 20, a second portion 42 wrapping around the inner wall 32 and extending along a length of the inner wall 32, and a distal portion 44 extending into the inner chamber 34. The distal portion 44 of the coil 38 includes an open end 46 positioned adjacent to the first end wall 24.

The substance 22 is typically a fluid 48 designed for producing smoke when the fluid 48 is heated above a flash point of the fluid 48. The flash point is defined as the temperature at which the fluid 48 changes into smoke at substantially atmospheric pressure. The fluid 48 is passed through the coil 38 and into the inner chamber 34 of the heating chamber 20 such that the fluid 48 is heated above the flash point, preferably while it is within the coil 38 where the limited volume of the coil 38 prevents immediate smoke formation and increased pressure urges the fluid 48 out of the coil 38. Thus, smoke is produced within the inner chamber 34 when the fluid 48 is passed through the open end 46 of the coil 38.

The outer wall 28 includes an outlet opening 50. Thus, the smoke produced in the inner chamber 34 is emitted from the heating chamber 20 through the outlet opening 50 after expanding and moving through the inner and outer chambers 34,36.

The above structure is sufficient to produce very low residue smoke but heating of the heating chamber 20, coil 38 and thus the substance 22 within the coil 38 is increased by addition of a medial wall 52 extending from the second end wall 26 into the interior 30 of the heating chamber 20. The medial wall 52 is positioned between the inner wall 32 and the outer wall 28 to define inner and outer portions, 54 and 56 respectively, of the outer chamber 36. The medial wall 52 includes an open end 58 adjacent to the first end wall 24. Thus, the substance 22 is dispersed into the hottest portion of the heating chamber 20 and smoke produced in the inner chamber 34 must pass into and through the inner portion 54 of the outer chamber 36 before passing into the outer portion 56 of the outer chamber 36. This convoluted pathway retains the smoke inside the heating chamber to increase the exposure to heat to maximize the burning of any potential residue from the conversion of the substance 22 to smoke. This also serves to assist in smoke production and complete use of the smoke producing substance even when the substance is initially dispensed as the heating chamber is being heated. Thus, any residue collected before the heating chamber reaches maximum temperature is retained and burned to produce smoke.

The outlet opening 50 is positioned proximate the first end wall 24. Thus, the smoke must additionally pass along substantially a full length of either the outer portion 56 of the outer chamber 36 when the medial wall 52 is present or the full length of the outer chamber 36 when the medial wall 52 is not present before being emitted through the outlet opening 50. This again serves to retain the smoke within the heating chamber 20 to maximize exposure to heat above the flash point to completely burn the substance and any potential residue.

A nozzle 60 is coupled to the outer wall 28 around the outlet opening 50 for directing the smoke emitted through the outlet opening 50 in a desired direction. In an embodiment, the nozzle 60 is fixed and substantially L-shaped for directing the smoke downward for reasons described below.

A lowermost edge 62 of the outlet opening 50 is positioned in a spaced elevation above a bottommost surface 64 of the interior of the heating chamber 20 for collecting any residual liquid 66 in the heating chamber 20 to prolong heating of the liquid 66 and minimize emission of the liquid 66 through the outlet opening 50. This structure is designed so that the liquid 66 is retained in the heating chamber 20 to increase exposure of the liquid 66 to high heat to enhance full vaporization or burning off of the liquid 66. The above structure has been found to drastically reduce residual liquid to an extremely low level, thus greatly increasing the amount of smoke produced per unit of the substance 22 and greatly enhancing the efficiency of smoke production.

Although the above heating chamber may be applied to any use where smoke production is desired the smoke producing system of the present invention has been applicable to testing conduits for leaks, particularly sewer and drainage pipes and systems. For such systems, the heat source is derived from a fan assembly 68. The heating chamber 20 is positioned adjacent to an engine at a hot point such as in close proximity to the exhaust pathway. The engine may be designed to deliver or concentrate heat on the The outlet opening 50 is positioned to emit the smoke into a stream of air produced by the fan assembly 68. The fan assembly 68 includes a skirt portion 70 designed for fitting over a manhole opening 2. The fan assembly 68 includes a fan blade 72 that is positioned directly into the manhole opening. The fan blade is further positioned adjacent to a distal opening of the nozzle so that the outlet opening 50 and the stream of air created by the fan blade are directed to send the smoke through the manhole opening.

For the particular use of emitting smoke into a sewer or drainage pipe system through a manhole opening, the fan assembly is placed over the manhole opening such that the fan blade is positioned in the manhole opening. A container of the smoke producing substance is connected to the first portion of the coil where a standardized quick connect mechanism may be employed. A primer mechanism is used to draw the substance into the coil. The fan assembly is started and begins producing heat. The heating chamber is coupled directly to the fan assembly such that the first end wall is heated directly by the heat from the fan assembly. The substance within the coil is superheated beyond the flash point and the smoke is produced upon the substance exiting the coil within the inner chamber. The smoke is then emitted through the outlet opening where it is put to the desired use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A smoke producing system comprising:

a heat source;

a heating chamber having first and second end walls, said first end wall being heated by said heat source, said heating chamber having an outer wall extending between said first and second end walls to define an interior of said heating chamber;

said heating chamber having an inner wall extending from said first end wall into said interior to define an inner chamber and an outer chamber within said heating chamber;

a coil having a first portion extending into said heating chamber, said coil having a second portion wrapping around said inner wall along a length of said inner wall, said coil having a distal portion extending into said inner chamber, said distal portion of said coil having an open end positioned adjacent to said first end wall;

a fluid adapted for producing smoke when said fluid is heated above a flash point of said fluid, said fluid being passable through said coil and into said inner chamber of said heating chamber such that said fluid is heated above said flash point whereby smoke is produced within said inner chamber when said fluid is passed through said open end of said coil;

said outer wall having an outlet opening whereby said smoke produced is emitted from said heating chamber through said outlet opening;

a medial wall extending from said second end wall into said interior of said heating chamber, said medial wall being positioned between said inner wall and said outer wall to define inner and outer portions of said outer chamber, said medial wall having an open end adjacent to said first end wall whereby smoke produced in said inner chamber must pass into and through said inner portion of said outer chamber before passing into said outer portion of said outer chamber.

2. The smoke producing system of claim 1 wherein said outlet opening is positioned proximate said first end wall whereby said smoke must pass along substantially a full length of said outer portion of said outer chamber before being emitted through said outlet opening.

3. A smoke producing system comprising:

a heat source;

a heating chamber having first and second end walls, said first end wall being heated by said heat source, said heating chamber having an outer wall extending between said first and second end walls to define an interior of said heating chamber;

said heating chamber having an inner wall extending from said first end wall into said interior to define an inner chamber and an outer chamber within said heating chamber;

a coil having a first portion extending into said heating chamber, said coil having a second portion wrapping around said inner wall along a length of said inner wall, said coil having a distal portion extending into said inner chamber, said distal portion of said coil having an open end positioned adjacent to said first end wall;

a fluid adapted for producing smoke when said fluid is heated above a flash point of said fluid, said fluid being passable through said coil and into said inner chamber of said heating chamber such that said fluid is heated above said flash point whereby smoke is produced within said inner chamber when said fluid is passed through said open end of said coil;

said outer wall having an outlet opening whereby said smoke produced is emitted from said heating chamber through said outlet opening;

wherein said outlet opening is positioned proximate said first end wall whereby said smoke must pass along substantially a full length of said outer chamber before being emitted through said outlet opening.

4. The smoke producing system of claim 1, further comprising:

a nozzle coupled to said outer wall around said outlet opening for directing said smoke emitted through said outlet opening.

5. The smoke producing system of claim 4 wherein said nozzle is substantially L-shaped for directing said smoke downward.

6. The smoke producing system of claim 1 wherein a lowermost edge of said outlet opening is positioned in a spaced elevation above a bottommost surface of said interior of said heating chamber for collecting liquid in said heating chamber to prolong heating of said liquid and minimize emission of said liquid through said outlet opening.

7. The smoke producing system of claim 1 wherein a lowermost edge of said outlet opening is positioned in a spaced elevation above a bottommost surface of said interior of said heating chamber for collecting liquid in said heating chamber to prolong heating of said liquid and minimize emission of said liquid through said outlet opening.

8. The smoke producing system of claim 1 wherein said heat source is a fan assembly, said outlet opening being positioned to emit said smoke into a stream of air produced by said fan assembly.

9. A smoke producing system comprising:

a heat source;

a heating chamber having first and second end walls, said first end wall being heated by said heat source, said heating chamber having an outer wall extending between said first and second end walls to define an interior of said heating chamber;

said heating chamber having an inner wall extending from said first end wall into said interior to define an inner chamber and an outer chamber within said heating chamber;

a coil having a first portion extending into said heating chamber, said coil having a second portion wrapping around said inner wail along a length of said inner wall, said coil having a distal portion extending into said inner chamber, said distal portion of said coil having an open end positioned adjacent to said first end wall;

a fluid adapted for producing smoke when said fluid is heated above a flash point of said fluid, said fluid being passable through said coil and into said inner chamber of said heating chamber such that said fluid is heated above said flash point whereby smoke is produced within said inner chamber when said fluid is passed through said open end of said coil;

said outer wall having an outlet opening whereby said smoke produced is emitted from said heating chamber through said outlet opening;

wherein said heat source is a fan assembly, said outlet opening being positioned to emit said smoke into a stream of air produced by said fan assembly wherein said fan assembly includes a skirt portion adapted for fitting over a manhole opening, said outlet opening and said stream of air being directed to emit said smoke through said manhole opening.

* * * * *